US008808781B2

(12) United States Patent
Stecker et al.

(10) Patent No.: US 8,808,781 B2
(45) Date of Patent: Aug. 19, 2014

(54) METHOD FOR PRODUCING VANILLIN BY ELECTROCHEMICAL OXIDATION OF AQUEOUS LIGNIN SOLUTIONS OR SUSPENSIONS

(75) Inventors: Florian Stecker, Mannheim (DE); Itamar Michael Malkowsky, Speyer (DE); Andreas Fischer, Heppenheim (DE); Siegfried R. Waldvogel, Ingelheim (DE); Carolin Regenbrecht, Mainz (DE)

(73) Assignees: BASF SE, Ludwigshafen (DE); Rheinische Friedrich-Wilhelms-Universitaet Bonn, Bonn (DE)

( * ) Notice: Subject to any disclaimer, the term of this patent is extended or adjusted under 35 U.S.C. 154(b) by 0 days.

(21) Appl. No.: 13/569,677

(22) Filed: Aug. 8, 2012

(65) Prior Publication Data

US 2013/0040031 A1 Feb. 14, 2013

Related U.S. Application Data

(60) Provisional application No. 61/522,284, filed on Aug. 11, 2011.

(30) Foreign Application Priority Data

Aug. 11, 2011 (EP) ..... 11177320
Jul. 4, 2012 (EP) ..... 12175005

(51) Int. Cl.
*A23L 1/22* (2006.01)
*C25B 3/00* (2006.01)
*C25B 3/02* (2006.01)

(52) U.S. Cl.
USPC ..... 426/538; 205/449; 205/412; 205/338

(58) Field of Classification Search
USPC ..... 205/448; 426/538
See application file for complete search history.

(56) References Cited

U.S. PATENT DOCUMENTS 4,786,382 A * 11/1988 Utley et al. ..... 205/689
5,526,223 A * 6/1996 Wu et al. ..... 361/508

FOREIGN PATENT DOCUMENTS

WO WO 87/03014 5/1987
WO WO 2009/138368 A1 11/2009

OTHER PUBLICATIONS

Carmen Z. Smith, et al., "Electro-Organic Reactions. Part 60[1]. The Electro-Oxidative Conversion at Laboratory Scale of a Lignosulfonate into Vanillin in an FM01 Filter Press Flow Reactor: Preparative and Mechanistic Aspects", J. Appl. Electrochem. DOI 10.1007/s10800-010-0245-0, 2011, 13 pages.

* cited by examiner

*Primary Examiner* — Humer Sheikh
*Assistant Examiner* — Bhaskar Mukhopadhyay
(74) *Attorney, Agent, or Firm* — Oblon, Spivak, McClelland, Maier & Neustadt, L.L.P.

(57) ABSTRACT

The present invention relates to a method for producing vanillin, which comprises an electrochemical oxidation of an aqueous, lignin-comprising suspension or solution at an anode, wherein the anode used is a silver electrode.

18 Claims, No Drawings

METHOD FOR PRODUCING VANILLIN BY ELECTROCHEMICAL OXIDATION OF AQUEOUS LIGNIN SOLUTIONS OR SUSPENSIONS

The invention relates to a method for producing vanillin by electrochemical oxidation of an aqueous lignin-comprising suspension or solution.

Lignins are a group of three-dimensional macromolecules that occur in the cell wall of plants and are composed of various phenolic monomer building blocks such as p-cumaryl alcohol, coniferyl alcohol and sinapyl alcohol. Lignins are incorporated into the plant cell wall during the growth of plants and effect thereby the lignification of the cell. About 20% to 30% of the dry matter of lignified plants comprises lignins. In addition to cellulose and chitin, lignins are therefore the most frequent organic compounds on earth.

Lignin and lignin-comprising substances such as alkali lignin, lignin sulfate or lignosulfonate occur in large amounts as a by-product in various industrial processes such as paper manufacture. The total production of lignin-comprising substances is estimated at about 20 billion tons per year. Lignin is therefore a very valuable raw material. Some of this lignin is now being further used. For example, alkali lignin, which can be produced by alkali treatment of the black liquor arising in paper manufacture, is used in North America as a binder for particle boards based on wood and cellulose, as dispersants, for clarification of sugar solutions, stabilization of asphalt emulsions and also foam stabilization. However, by far the greatest amount of waste lignin is used as an energy donor, e.g. for the pulp process, by combustion. Since lignin is an aromatic valuable material, in addition to its energetic utilization, it is desirable to convert lignin to other valuable materials to a greater extent.

Vanillin, 4-hydroxy-3-methoxybenzaldehyde, is a synthetic flavoring which is used in the place of expensive natural vanilla to a great extent as a flavoring for chocolate, confectionary, liqueurs, bakery products and other sweet foods and also for producing vanilla sugar. Smaller amounts are used in deodorants, perfumes and for flavor enhancement of pharmaceuticals and vitamin preparations. Vanillin is also an intermediate in the synthesis of various medicaments such as, e.g., L-dopa, methyldopa and papaverine. There is therefore fundamental interest in novel economic methods for producing vanillin.

The flavoring vanillin, owing to the structural similarity thereof to the basic building blocks of lignin, is suitable as a target molecule for syntheses proceeding from lignin.

WO 87/03014 describes a method for the electrochemical oxidation of lignin at temperatures of preferably 170 to 190° C. in aqueous, strongly alkaline solutions with mixing during the electrolysis. As anodes, primarily copper or nickel electrodes are used. As low-molecular-weight product, a complex mixture is obtained which comprises, inter alia, vanillic acid (4-hydroxy-3-methoxybenzoic acid), vanillin, 4-hydroxybenzaldehyde, 4-hydroxyacetophenone and acetovanillone (4-hydroxy-3-methoxyacetophenone) and also optionally phenol, syringic acid (4-hydroxy-3,5-dimethoxybenzoic acid) and syringaldehyde (4-hydroxy-3,5-dimethoxybenzaldehyde). Generally, 4-hydroxybenzoic acid is the main product. Only when nickel electrodes are used is it possible to obtain vanillin as the main product of the electrolysis, temperatures of 170° C. and 3M sodium hydroxide solution as electrolyte being required, however. The strongly alkaline conditions and the high temperatures, however, lead to the low-molecular-weight products formed in the oxidation suffering breakdown reactions such as superoxidation and disproportionation. In addition, the aqueous alkaline solutions, under the conditions described in WO 87/03014, are highly corrosive and lead to a destruction of the electrolysis cell and the electrode material. These corrosion processes give rise to a not inconsiderable heavy metal introduction into the products obtained, such that they are no longer suitable for the food industry even after purification.

C. Z. Smith et al. J. Appl. Electrochem. 2011, DOI 10.1007/s10800-010-0245-0 likewise describe studies on the electrochemical oxidation of lignin sulfate to vanillin under alkaline conditions in the presence of nickel electrodes at temperatures of 170° C. The electrolysis cell used is a cell with circulation in which the lignin sulfate-comprising electrolyte is continuously circulated through a cylindrical electrode arrangement having a central cylindrical nickel grid as cathode and a nickel grid cylindrically surrounding the cathode as anode.

WO 2009/138368 describes a method for the electrolytic breakdown of lignin, in which an aqueous lignin-comprising electrolyte is oxidized in the presence of a diamond electrode. In this method, inter alia, a low-molecular-weight product is formed which comprises, in roughly equal fractions, vanillin together with other hydroxybenzaldehyde derivatives such as acetovanillin or guaiacol. The selectivity of lignin oxidation with respect to vanillin is therefore low. As the inventors' own studies have found, the diamond electrode does not stand up to the strongly corrosive conditions at basic pH values during electrolysis. Already after a short time, the diamond electrode is severely damaged. It is therefore necessary to carry out the electrolysis in the acidic pH range.

The object of the present invention is to provide a method which permits the production of vanillin by electrochemical oxidation of lignin or lignin-comprising substances in good yields and with high selectivity with respect to the formation of vanillin. In addition, the method should be able to be carried out under conditions which are less corrosive than the conditions of the prior art and attack the electrodes used less severely. In particular, the vanillin should be obtained in a form which does not preclude use as flavoring in the food industry.

These and other objects are achieved by the method described hereinafter for the electrochemical oxidation of lignin-comprising aqueous matter streams in which, as anode, a silver electrode is used.

The present invention therefore relates to a method for producing vanillin, which comprises an electrochemical oxidation of an aqueous, lignin-comprising suspension or solution at an anode, wherein the anode used is a silver electrode.

The present invention further relates to the use of the vanillin which was produced by the method according to the invention as flavoring in the food industry.

The method according to the invention is associated with a series of advantages. The electrode materials used thus lead to a significant increase in selectivity. This high selectivity can surprisingly also be achieved at a comparatively low temperature of up to 100° C. In addition, the anode materials used according to the invention prove to be extremely resistant with respect to the corrosive reaction conditions and, unlike in the methods of the prior art, no corrosion or no appreciable corrosion occurs.

Lignin-comprising aqueous solutions or suspensions, here and hereinafter, are taken to mean an aqueous solution or suspension which comprises lignin or lignin derivatives, for example lignin sulfate, lignosulfonate, kraft lignin, alkali lignin or organosolv lignin or a mixture thereof, as lignin component. The aqueous solution or suspension can be an aqueous solution or suspension which is produced as a by-product in an industrial process such as the manufacture of paper pulp, pulp or cellulose, e.g. black liquor, and the lignin-comprising wastewater streams from the sulfite process, from the sulfate process, from the organocell or organosolv process, from the ASAM process, from the kraft process or from the natural pulping process. The aqueous solution or suspension can be an aqueous solution or suspension which is produced by dissolution of a lignin or lignin derivative, e.g. lignin sulfate, lignosulfonate, kraft lignin, alkali lignin or organosolv lignin, of a lignin which is produced in an industrial process such as the production of paper pulp, pulp or cellulose, e.g. lignin from black liquor, from the sulfite process, from the sulfate process, from the organocell or organosolv process, from the ASAM process, from the kraft process or from the natural pulping process.

In the method according to the invention, an aqueous, lignin-comprising electrolyte which comprises lignin or a lignin-comprising substance and is in the form of an aqueous suspension or solution is subjected to an electrochemical oxidation, i.e. an electrolysis. In this case, at the anode, the oxidation of the lignin or lignin derivative present takes place. At the cathode, typically, a reduction of the aqueous electrolytes proceeds, e.g. with formation of hydrogen.

In the method according to the invention, as anode, in principle any silver electrode known to a person skilled in the art can be used. This can be made up completely of silver or a silver-comprising alloy or be a support electrode which has a support that is coated with silver or a silver-comprising alloy. The electrodes used as anode can be, for example, electrodes in the form of expanded metals, grids or metal sheets.

As silver-comprising alloy, silver-comprising coin alloys that are known to those skilled in the art can be used. In addition to silver, these comprise preferably copper, nickel, iron or mixtures of these metals. Those which may be mentioned are copper-silver, nickel-silver, silver-iron and copper-nickel-silver. Preferred silver alloys typically have a silver content of at least 50% by weight. The proportion of further silver constituents is typically in the range from 1 to 40% by weight, in particular in the range from 5 to 35% by weight. Examples of such silver alloys are an alloy of 90% by weight of silver and 10% by weight of nickel, and cupro silver, which is an alloy of 72.5% by weight of silver and 27.5% by weight of copper.

Preferably, as anode, a silver electrode is used, in which silver or a silver-comprising alloy is arranged as coating on an electrically conducting support that is different from silver. The thickness of the silver layer in this case is generally less than 1 mm, e.g. 10 to 300 μm, preferably 10 to 100 μm.

Suitable support materials for such silver-coated electrodes are electrically conducting materials such as niobium, silicon, tungsten, titanium, silicon carbide, tantalum, copper, gold, nickel, iron, graphite, ceramic supports such as titanium suboxide or silver-comprising alloys. Preferred supports are metals, in particular metals having a standard potential lower than silver such as, for example, iron, copper, nickel or niobium. It is preferred to use supports in the form of expanded metals, grids or metal sheets, wherein the supports comprise, in particular, the abovementioned materials. In particular, these expanded metals or metal sheets comprise up to 50% by weight, preferably 75% by weight, in particular 95% by weight, based on the total weight of the support, of iron, copper or nickel.

As cathode, in principle any electrode which is known to those skilled in the art and is suitable for the electrolysis of aqueous systems can be used. Since, at the cathode, reduction processes take place and the vanillin is oxidized at the anode, when a heavy metal electrode is used such as, for example, a nickel cathode, the pollution of the vanillin with this heavy metal is so low that the resultant vanillin can be used in a problem-free manner in the food industry. Nevertheless, it is advantageous not to use cathodes which comprise nickel or lead. Preferably, the electrode materials exhibit a low hydrogen overpotential. Preference is given to electrodes here which comprise an electrode material selected from silver, nickel, silver-comprising alloys, $RuO_xTiO_x$ mixed oxide, platinated titanium, platinum, stainless steel, graphite or carbon. Particularly preferably, here, an electrode material is selected from silver, platinated titanium, nickel, platinum or stainless steel, above all silver, nickel and platinum. Particularly preferably, the cathode is a coated noble metal electrode. As noble metal layer, coatings which come in particular into consideration are of silver or platinum or alloys which comprise substantially, i.e. at least 50% by weight, silver, platinum or mixtures thereof. The thickness of the noble metal layer in this case is generally less than 1 mm, e.g. 10 to 300 μm. Suitable support materials for such electrodes coated with noble metal are electrically conducting materials as have been cited hereinbefore in connection with the silver electrode. It is preferred to use supports in the form of expanded metals, grids or metal sheets, wherein the supports comprise, in particular, the abovementioned materials. In particular, these expanded metals or metal sheets comprise 50% by weight, preferably 75% by weight, in particular 95% by weight, based on the total weight of the support, iron or copper.

The arrangement of anode and cathode is not restricted and comprises, for example, arrangements of planar meshes and/or plates which can also be arranged in the form of a plurality of stacks of alternating poles, and cylindrical arrangements of cylindrically shaped nets, grids or tubes, which can also be arranged in the shape of a plurality of cylinders of alternating poles.

For achieving optimum space-time yields, various electrode geometries are known to those skilled in the art. Those which are advantageous are a bipolar arrangement of a plurality of electrodes, an arrangement in which a rod-shaped anode is encompassed by a cylindrical cathode, or an arrangement in which not only the cathode but also the anode comprises a wire net and these wire nets were placed one on top of the other and rolled up cylindrically.

In one embodiment of the invention, the anode and cathode are separated from one another by a separator. In principle, suitable separators are all separators customarily used in electrolysis cells. The separator is typically a porous planar material arranged between the electrodes, e.g. a grid, net, woven fabric or nonwoven, made of a non-electrically conducting material which is inert under the electrolysis conditions, e.g. a plastics material, in particular a Teflon material or a Teflon-coated plastics material.

For the electrolysis, any electrolysis cells known to those skilled in the art can be used, such as a divided or undivided continuous-flow cell, capillary gap cell or stacked-plate cell. Particular preference is given to the undivided continuous-flow cell, e.g. a continuous-flow cell with circulation, in which the electrolyte is continuously circulated past the electrodes. The method can be carried out with good success not only discontinuously but also continuously.

The method according to the invention can likewise be carried out on an industrial scale. Corresponding electrolysis cells are known to those skilled in the art. All embodiments of this invention relate not only to the laboratory scale but also to the industrial scale.

In a preferred embodiment of the invention, the contents of the electrolysis cell are mixed. For this mixing of the cell contents, any mechanical agitator known to those skilled in the art can be used. The use of other mixing methods, such as Ultraturrax, ultrasound or jet nozzles is likewise preferred.

By applying the electrolysis voltage to the anodes and the cathodes, electrical current is passed through the electrolyte. In order to avoid side reactions such as overoxidation and oxyhydrogen gas formation, generally a current density of 1000 mA/cm$^2$, in particular 100 mA/cm$^2$, will not be exceeded. The current densities at which the method is carried out are generally 1 to 1000 mA/cm$^2$, preferably 1 to 100 mA/cm$^2$. Particularly preferably, the method according to the invention is carried out at current densities between 1 and 50 mA/cm$^2$.

The total time of electrolysis depends of course on the electrolysis cell, the electrodes used and the current density. An optimum time can be determined by a person skilled in the art by routine experiments, e.g. by sampling during the electrolysis.

In order to avoid a deposit on the electrodes, the polarity can be changed in short time intervals. The polarity can be changed in an interval of 30 seconds to 10 minutes, preference is given to an interval of 30 seconds to 2 minutes. For this purpose it is expedient that anode and cathode comprise the same material.

Methods known from the prior art must frequently be carried out at high pressure and at temperatures far above 100° C. This makes particular demands on the electrolysis cell since it must be designed for overpressure. In addition, not only the electrolysis cell but also the electrodes suffer under the corrosive conditions which are established at a high temperature. In the method according to the invention, it is not necessary to operate at high pressures and temperatures.

The electrolysis is carried out in accordance with the method according to the invention generally at a temperature in the range from 0 to 100° C., preferably 50 to 95° C., in particular 75 to 90° C.

In the method according to the invention the electrolysis is generally carried out at a pressure below 2000 kPa, preferably below 1000 kPa, in particular below 150 kPa, e.g. in the range from 50 to 1000 kPa, in particular 80 to 150 kPa. Particularly preferably, the method according to the invention is carried out at a pressure in the range of atmospheric pressure (101±20 kPa).

In a particularly preferred embodiment, the method according to the invention is carried out at 80° C. to 85° C. and in the range of atmospheric pressure (101±20 kPa).

The aqueous, lignin-comprising suspension or solution generally comprises 0.5 to 30% by weight, preferably 1 to 15% by weight, in particular 1 to 10% by weight, lignin, based on the total weight of the aqueous, lignin-comprising suspension or solution.

In all processes of the manufacture of paper, pulp or cellulose, lignin-comprising wastewater streams occur. These can be used as aqueous, lignin-comprising suspension or solution in the method according to the invention. The wastewater streams of the sulfite process for paper manufacture frequently comprise lignin as lignosulfonic acid. Lignosulfonic acid can be used directly in the method according to the invention or can first be hydrolyzed under alkaline conditions. In the sulfate process or kraft process, lignin-comprising wastewater streams occur, e.g. in the form of black liquor. In the organocell process which, owing to its environmental friendliness, will attain further importance in future, the lignin occurs as organosolv lignin. Lignosulfonic acid-comprising or organosolv lignin-comprising wastewater streams and also black liquor are particularly suitable as aqueous, lignin-comprising suspension or solution for the method according to the invention.

Alternatively, the aqueous, lignin-comprising suspensions or solutions can also be produced by dissolution or suspension of at least one lignin-comprising material. The lignin-comprising material preferably comprises at least 10% by weight, in particular at least 15% by weight, and particularly preferably at least 20% by weight, lignin, based on the total weight of the lignin-comprising material. The lignin-comprising material is preferably selected from straw, bagasse, kraft lignin, lignosulfonate, oxidized lignin, organosolv lignin or other lignin-comprising residues from the paper industry or fiber production, in particular from kraft lignin, lignosulfonate and oxidized lignin which occurs on electrochemical oxidation of non-oxidized lignin.

In a preferred embodiment, oxidized lignin is used which originates from a previous electrolysis cycle. It has proved to be advantageous here to use oxidized lignin in at least one further electrolysis cycle, preferably in at least two further electrolysis cycles, and in particular in at least three further electrolysis cycles. It is advantageous of this repeated use of the oxidized lignin that vanillin can be obtained repeatedly. Therefore, the yield of vanillin, based on the amount of lignin originally used, is markedly increased and therefore the economic efficiency of the total method is increased. In addition, owing to the repeated use of the oxidized lignin, the concentration of the oxidation-sensitive vanillin in the electrolyte per oxidation operation can be kept low such that the unwanted side reactions such as overoxidation can be effectively suppressed, whereas the total yield of vanillin increases over the total process (plurality of electrolysis cells).

For improvement of the solubility of the lignin in the aqueous, lignin-comprising suspension or solution, it can be advantageous to dissolve or suspend the lignin-comprising material together with inorganic bases. Inorganic bases which can be used are alkali metal hydroxides such as NaOH or KOH, ammonium salts such as ammonium hydroxide, and alkali metal carbonates such as sodium carbonate, e.g. in the form of soda. Preference is given to alkali metal hydroxides, in particular NaOH and KOH. The concentration of inorganic bases in the aqueous, lignin-comprising suspension or solution should not exceed 5 mol/l and in particular 4 mol/l and is then typically in the range from 0.01 to 5 mol/l, in particular in the range from 0.1 to 4 mol/l.

Particular preference is given to use of wastewater streams or residues from the manufacture of paper and pulp, in particular black liquor or kraft lignin.

At high lignin concentrations in the aqueous, lignin-comprising suspension or solution, the viscosity of the solution or suspension can greatly increase, and the solubility of the lignin can become very low. In these cases, it can be advantageous, before the electrochemical oxidation, to carry out a prehydrolysis of the lignin which improves the solubility of the lignin and the viscosity of the aqueous, lignin-comprising suspension or solution is decreased. Typically, for the prehydrolysis of lignin, this is heated in an aqueous alkali metal hydroxide solution to above 100° C. The concentration of the alkali metal hydroxide is generally in the range from 0.1 to 5 mol/l, preferably 0.5 to 5 mol/l, in particular 1.0 to 3.5 mol/l. Preferably, sodium hydroxide or potassium hydroxide is used. In a preferred embodiment of the prehydrolysis method, the lignin-comprising alkali metal hydroxide solution is heated to a temperature of 150 to 250° C., in particular 170 to 190° C., and stirred vigorously for 1 to 10 h, preferably 2 to 4 h. The prehydrolyzed lignin can be separated off from the alkali metal hydroxide solution before the electrochemical oxidation. Alternatively, it is possible to carry out the electrochemical oxidation directly with the lignin-comprising alkali metal hydroxide solution.

The method according to the invention makes it possible in principle to work both in the acid and in the alkaline pH range. In the method according to the invention, the aqueous, lignin-comprising suspension or solution generally has a pH in the range from pH 0 to 14, frequently in the range from pH 6 to 14, preferably in the range from pH 7 to 13, in particular in the range from pH 8 to 13.

As discussed previously, the vanillin formed in the electrolysis is sensitive under alkaline conditions to oxidation and disproportionation processes. Therefore, it is fundamentally advantageous for the stability of the resultant vanillin to work at low pHs. Since the solubility of the lignin and many of the derivatives thereof is highest in the alkaline range, it can be expedient, despite the stability problems of vanillin, to work in the alkaline range. Owing to the use of silver electrodes, however, it is possible to employ very much milder electrolysis conditions than in the prior art, so that the breakdown of the vanillin occurs only to a relatively minor extent, or can even be avoided.

In a first embodiment of the method according to the invention, the aqueous, lignin-comprising suspension or solution has a pH from pH 0 to pH 8, preferably from pH 1 to 5, especially pH 1 to pH 3. Preferably, the pH is adjusted using readily water-soluble inorganic acids such as hydrochloric acid, sulfuric acid, nitric acid, or organic acids such as para-toluenesulfonic acid or mixtures of various acids. Particular preference is given to sulfuric acid.

In a further preferred embodiment of the method according to the invention, the aqueous, lignin-comprising suspension or solution has a pH in the range from pH 6 to pH 14, preferably from pH 7 to pH 13, in particular from pH 8 to pH 13.

In a further preferred embodiment of the method according to the invention, the aqueous, lignin-comprising suspension or solution has a pH of at least pH 8, in particular at least pH 10 and especially at least pH 12, e.g. a pH in the range from pH 8 to pH 14, preferably from pH 10 to pH 14, in particular from pH 12 to pH 14.

To improve the solubility of the lignin, to the aqueous, lignin-comprising suspension or solution, in this case, as additive, alkali metal hydroxides, in particular NaOH or KOH, are added. The concentration of the alkali metal hydroxides is generally in a range from 0.1 to 5 mol/l, frequently in the range from 0.5 to 5 mol/l, preferably from 1 to 3.5 mol/l, in particular from 1.0 to 3.0 mol/l. Some wastewater streams of the manufacture of paper and pulp such as, e.g., black liquor, already have, due to production, a corresponding concentration alkali metal hydroxides.

The aqueous, lignin-comprising suspension or solution can comprise a conducting salt to improve conductivity. This generally concerns alkali metal salts such as salts of Li, Na, K or quaternary ammonium salts such as tetra($C_1$-$C_6$ alkyl) ammonium or tri($C_1$-$C_6$ alkyl)methylammonium salts. Counter ions which come into consideration are sulfate, hydrogensulfate, alkylsulfates, arylsulfates, halides, phosphates, carbonates, alkylphosphates, alkylcarbonates, nitrate, alcoholates, tetrafluoroborate, hexafluorophosphate, perchlorate or bistriflate or bistriflimide.

In addition, as conducting salts, ionic liquids are also suitable. Suitable electrochemically stable ionic liquids are described in "Ionic Liquids in Synthesis", editors: Peter Wasserscheid, Tom Welton, Verlag Wiley-VCH 2003, chapters 1 to 3.

For the electrochemical oxidation of lignin, a metal-comprising or metal-free mediator can be added to the aqueous, lignin-comprising suspension or solution. Mediators are taken to mean redox pairs which make possible an indirect electrochemical oxidation. The mediator is converted electrochemically to the higher oxidation state, and then acts as oxidizing agent and is regenerated thereafter by electrochemical oxidation. This is therefore an indirect electrochemical oxidation of the organic compound, since the mediator is the oxidizing agent. The oxidation of the organic compound by the mediator in the oxidized form can be carried out in this case in the electrolysis cell in which the mediator was converted into the oxidized form, or in one or more separate reactors ("ex-cell method"). The last-mentioned method has the advantage that any remaining traces of the organic compound that is to be oxidized do not interfere in the production or regeneration of the mediator.

Suitable mediators are compounds which can exist in two oxidation states, act as oxidizing agents in the higher oxidation state and can be regenerated electrochemically. Mediators which can be used are, e.g., salts or complexes of the following redox pairs: Ce (III/IV), Cr (II/III), Cr (III/VI), Ti (II/III), V (II/III), V (III/IV), V (IV/V), Ag (I/II), $AgO^+/AgO^-$, Cu (I/II), Sn (II/IV), Co (II/III), Mn (II/III), Mn (II/IV), Os (IV/VIII), Os (III/IV), $Br_2/Br^-/BrO_3$, $I^-/I_2$, $I_3^+/I_2$ $IO_3^+/IO_4^-$, Fremy's salt (dipotassium nitrosodisulfonate) or else organic mediators, such as ABTS (2,2'-azino-bis(3-ethylbenzothiazoline-6-sulfonic acid), TEMPO, viologens such as violuric acid, $NAD^+/NADH$, $NADP^+/NADPH$, wherein the systems cited can also be metal complexes with diverse ligands or else solvent ligands, such as, e.g., $H_2O$, $NH_3$, $CN^-$, $OH^-$, $SCN^-$, halogens, $O_2$, acetylacetonate, dipyridyl, phenanthroline or 1,10-phenanthroline 5,6-dione. Preferably, in the method according to the invention, mediators free from transition metals, e.g. nitrosodisulfonates such as Fremy's salt (dipotassium nitrosodisulfonate) are used. The mediator is preferably used in amounts of 0.1 to 30% by weight, particularly preferably from 1 to 20% by weight, based on the total weight of the aqueous, lignin-comprising suspension or solution.

In a particularly preferred embodiment, the method according to the invention is carried out without addition of mediators.

The aqueous, lignin-comprising suspension or solution can in addition comprise an inert solvent. Suitable solvents are polar-aprotic solvents having a high electrochemical stability such as acetonitrile, propionitrile, adiponitrile, suberodinitrile, propylene carbonate, ethylene carbonate, dichloromethane, nitromethane, chloroform, carbon tetrachloride, 1,2-dichloroethane, 1,1,2,2-tetrachloroethane, trichloroethylene, tetrachloroethylene, hexafluoroacetone, N-methylpyrrolidone, hexamethylphosphoric triamide, dimethyl sulfoxide and dimethyipropyleneurea (DMPU). Further suitable polar-aprotic solvents are described in Kosuke Izutsu, "Electrochemistry in Nonaqueous Solutions", Verlag Wiley-VCH 2002, chapter 1.

In the method according to the invention, inert solvents are generally used in an amount of no more than 60% by weight, preferably no more than 30% by weight, in particular no more than 20% by weight, e.g. 2.5 to 30% by weight, or 5 to 20% by weight, based on the total amount of the aqueous, lignin-comprising suspension or solution used.

The vanillin obtained by the method according to the invention can be removed from the aqueous, lignin-comprising solution by methods known to those skilled in the art. Preferably, the vanillin is removed by distillation or extraction of the aqueous, lignin-comprising suspension or solution.

Suitable distillation methods are distillation processes known to those skilled in the art such as, e.g., vacuum distillation, distillation under a protecting gas atmosphere, or steam distillation. An advantage of separating off vanillin by distillation processes is that the vanillin is not brought into contact with organic solvents that are potentially hazardous to health.

Vanillin can likewise be removed by extraction from the aqueous, lignin-comprising suspension or solution. This is particularly advantageous, since the sensitive vanillin is not exposed to a further thermal stress. Extraction processes known to those skilled in the art are suitable therefor.

The aqueous, lignin-comprising suspension or solution can be admixed with an organic solvent in order thus to separate off the vanillin formed (liquid-liquid extraction). Suitable organic solvents are water-immiscible organic solvents, e.g. hydrocarbons having 5 to 12 carbon atoms such as hexane or octane, chlorinated hydrocarbons having 1 to 10 carbon atoms such as dichloromethane or chloroform, aliphatic ethers having 2 to 10 carbon atoms such as diethyl ether or diisopropyl ether, cyclic ethers or aliphatic esters such as ethyl ethanoate. Preference is given to halogen-free organic solvents. In addition, it is possible to extract vanillin with the aid of supercritical fluids. Supercritical $CO_2$ is suitable, in particular, therefor.

The lignin formed can likewise be removed from the aqueous, lignin-comprising suspension or solution by solid-phase extraction. Solid-phase extraction media are added for this purpose to the aqueous, lignin-comprising suspension or solution. The vanillin (vanillate) adsorbed to the extraction medium can then be eluted from the solid phase using polar organic solvents known to those skilled in the art such as, e.g., methanol. In addition, a solid-phase extraction similar to the solid-phase synthesis is also possible. In this case, the vanillin is covalently bound as vanillate to the solid phase. After separating off the solid phases from the aqueous, lignin-comprising suspension or solution, the vanillin is liberated again by breaking the covalent bond. In both cases a concentrated raw product is obtained which can then be purified and isolated more simply by distillation.

In a preferred embodiment of the method according to the invention, the vanillin generated is removed from the aqueous, lignin-comprising solution or suspension by solid-phase extraction.

In addition, it is possible to free the aqueous, lignin-comprising suspension or solution from the volatile components of the solution or suspension before separating off the vanillin. The vanillin can then be extracted from the remaining residue using the abovementioned extraction media.

Separating off the vanillin can proceed continuously or discontinuously. It is particularly advantageous to remove the vanillin from the aqueous, lignin-comprising suspension or solution continuously during the electrochemical oxidation. In particular, it is preferred to remove the vanillin from the aqueous, lignin-comprising solution by continuous (solid-phase) extraction or steam distillation.

Overoxidation products of vanillin which can be formed during the electrolysis may be easily removed. Studies by the inventors have found that overoxidation products which were formed in the presence of a silver electrode used according to the invention have a high fraction of carboxyl groups and so they can be removed from the reaction product in a simple manner by techniques known to those skilled in the art such as the use of an ion exchanger or extraction.

In accordance with the method according to the invention, the vanillin is produced without the use of a heavy metal anode. Therefore, owing to the low heavy metal pollution of the vanillin produced, said vanillin can be used in the food industry. The invention therefore further relates to the use of the vanillin which has been produced by the method described as flavoring in the food industry.

After completion of the electrolysis, the aqueous, lignin-comprising suspension or solution, in addition to the vanillin formed, still comprises oxidized lignin. After separating off the vanillin and optionally other low-molecular-weight products, the oxidized lignin can be obtained by drying the aqueous, lignin-comprising solution. A lignin produced in this manner can be used, for example, advantageously as an additive in the construction material industry, for example as additive to cement or concrete.

The examples hereinafter are intended to describe the invention further and are not to be understood as restricting.

Analysis

For gas-chromatographic analysis of the electrolysis products, as stationary phase, an HP-5 column from Agilent of 30 m length, 0.25 mm diameter and 1 μm film thickness was used. This column is heated by means of a temperature program from 50° C. in the course of 10 min at 10° C./min to 290° C. This temperature is maintained for 15 min. The carrier gas used was hydrogen at a flow rate of 46.5 ml/min.

EXAMPLE 1

520 mg of kraft lignin were dissolved with stirring in an electrolyte of 81 g of 3M aqueous NaOH in an undivided cell. The cell has an anode of silver metal sheet and a cathode of nickel metal sheet (each 2.5 cm×3 cm) which are mounted in parallel to one another at a distance of 0.5 cm. The solution was electrolyzed with stirring for 28 hours (Q=1411 C) at a current density of 1.9 mA/cm$^2$ and a temperature of 80° C. The cell voltage which is established was in the range 2-3 V. After the charge quantity had flown through, the cell contents were cooled to room temperature and admixed with a known amount of a standard (n-hexadecane). Then, any solids present were filtered. The solution was then adjusted to pH~1-2 using 10% strength aqueous hydrochloric acid and admixed with 20 ml of dichloromethane. The gelatinous solid that precipitated out was filtered through kieselguhr and rinsed with dichloromethane. The organic phase is separated off. The aqueous phase was again extracted three times each time with 80 ml of dichloromethane. The combined organic phases were washed with 50 ml of water and 50 ml of saturated common salt solution before they were then dried over $Na_2SO_4$. After the solvent was removed under reduced pressure, an oily, gold-brown residue remained which was analyzed by gas chromatography with respect to its composition.

The gas-chromatographic analysis of the organic crude product gave the following typical composition, based on lignin used (% by weight): 1.20% vanillin, 0.66% acetovanillone, 0.21% vanillic acid. The selectivity for vanillin is therefore 58%.

EXAMPLE 2

The electrolysis was carried out in a similar manner to example 1 with the following change: the solution was electrolyzed for 20 hours (Q=1000 C). Typical composition of the organic extracts, based on lignin used (% by weight): 1.04% vanillin, 0.56% acetovanillone, 0.25% vanillic acid. This gives a selectivity for vanillin of 56.2%.

COMPARATIVE EXAMPLE

The procedure was performed in a similar manner to example 1 with the following change: the solution was electrolyzed for 22 hours (Q=1411 C) using an Ni anode and an Ni cathode. Typical composition of the organic extracts, based on lignin used (% by weight): 0.57% vanillin, 0.09% acetovanillone.

EXAMPLE 3

8.336 g of kraft lignin were placed into a temperature-controllable cell having a cooling jacket and dissolved with stirring in 1008 g of 3 M aqueous NaOH. In the electrolysis arrangement, 11 silver metal sheets (each 6.5 cm×7.0 cm) were connected in a bipolar manner at a distance of 0.3 cm in such a manner that the cell consisted of ten half chambers. The electrolysis proceeded galvanostatically at a current density of j=1.9 mA/cm$^2$ and a temperature of 80° C. The solution was electrolyzed for 12.6 hours (Q=4000 C; based on electrolyte: Q=40 000 C). The cell voltage which was established was in the range of 3-3.5 V. After the charge quantity had flowed through, the cell contents were brought to room temperature and filtered off from any solid present via a frit. The filtrates were adjusted to pH 1-2 using 10% strength aqueous hydrochloric acid and admixed with 100 ml of dichloromethane. The gelatinous solid that precipitated out was filtered through kieselguhr and rinsed with dichloromethane.

The organic phase of the filtrate was separated off and the aqueous phase, in two portions, was extracted in each case four times, each time with 100 ml of dichloromethane. The combined organic phases were washed with 200 ml of saturated common salt solution before they were then dried over $Na_2SO_4$. After the solvent was removed under reduced pressure, an oily, gold-brown residue remained which was purified by column chromatography (kieselgel 60, cyclohexane-ethyl acetate gradient v/v 3:2→1:1).

Purification of the organic crude product by column chromatography (m=191 mg) gave the following typical yield, based on lignin used:

Passage 1: 15 mg=0.18% guaiacol; 45 mg=0.54% vanillin; 20 mg=0.24% acetovanillone.

The lignin residue in the frit was dissolved from the kieselguhr by adding 1008 g of 3 M NaOH. After filtration, the solution was again electrolyzed under the abovementioned conditions, worked up and characterized. The column-chromatographic purification of the organic crude product (m=76 mg) gave the following typical yields, based on lignin used (% by weight):

Passage 2: 39 mg=0.47% vanillin.

EXAMPLE 4

523 mg of kraft lignin were dissolved in an electrolyte of 80 g of 1 M aqueous NaOH, in a temperature-controllable undivided cell with stirring. The cell had two electrodes made of silver metal sheet (each 2.5 cm×3.2 cm) which were connected in parallel to one another at a spacing of 0.5 cm. The solution was electrolyzed at a current density of 1.9 mA/cm$^2$ and a temperature of 80° C. for 24.5 hours (Q=1411 C). After the charge quantity had flowed through, the cell contents were cooled to room temperature and admixed with a known amount of a standard (n-hexadecane). Then, the solution was adjusted to pH=1-2 using 10% strength aqueous hydrochloric acid and admixed with 20 ml of dichloromethane. The gelatinous solid that precipitated out was filtered through kieselguhr and rinsed with dichloromethane. The organic phase was separated off. The aqueous phase was extracted again three times, each time using 80 ml of dichloromethane. The combined organic phases were washed with 50 ml of water and 50 ml of saturated common salt solution, before they were then dried over $Na_2SO_4$. After the solvent was removed at reduced pressure, an oily, gold-brown residue remained (m=15 mg) which was analyzed with respect to its composition by gas chromatography.

The gas chromatographic analysis of the organic crude product gave the following typical yields, based on lignin used (% by weight): 0.65% vanillin, 0.12% acetovanillone.

EXAMPLE 5

The electrolysis was performed in a similar manner to example 4 with the following change: 526 mg of kraft lignin were dissolved with stirring in an electrolyte of 80 g of 0.5 M aqueous NaOH and electrolyzed at a current density of 1.9 mA/cm$^2$ and a temperature of 80° C. for 20.6 hours (Q=1411 C). Typical composition of the organic extracts (m=57 mg), based on lignin used (% by weight): 1.37% vanillin, 0.10% acetovanillone.

EXAMPLE 6

The electrolysis was carried out in a similar manner to example 4 with the following change: 525 mg of alkali lignin were dissolved with stirring in an electrolyte of 86 g of 3 M NaOH and electrolyzed at a current density of 1.9 mA/cm$^2$ and a temperature of 80° C. for 20.6 hours (Q=1411 C). Two silver metal plates (4.0 cm×2.5 cm) at a spacing of 0.5 cm were used as electrodes. Typical yields of the organic extracts (m=41 mg) based on lignin used (% by weight): 0.76% vanillin, 0.37% acetovanillone, 0.88% vanillic acid.

COMPARATIVE EXAMPLE 2

The electrolysis was carried out in a similar manner to example 4 with the following change: the cell had two electrodes made of nickel metal plate (each 2.5 cm×4.0 cm) which were mounted in parallel to one another at a spacing of 0.5 cm.

525 mg of alkali lignin were dissolved with stirring in an electrolyte of 80 g of 1 M NaOH and electrolyzed at a current density of 1.9 mA/cm$^2$ and a temperature of 80° C. for 23.1 hours (Q=1411 C). Typical yield of the organic extracts (m=38 mg), based on lignin used (% by weight): 0.38% vanillin.

EXAMPLES 7 TO 9

524-526 mg of kraft lignin were dissolved with stirring in 80 g of electrolyte in a temperature-controllable undivided cell. The cell had an anode made of Ag/Ni alloy (0.5 cm×32.5 cm) which was fastened in a spiral manner in the cell. The alloy consisted of 90% silver and 10% nickel. The cathode used was a nickel grid which was immersed centrally in the spiral in the electrolyte. The solution was electrolyzed at a current density of 1.9 mA/cm$^2$ and a temperature of 80° C. (Q=1411 C) for 12.6 hours. The maximum terminal voltage during the reaction was 3.0 V. After the charge quantity had flowed through, the cell contents were cooled to room temperature, admixed with a known amount of a standard (n-hexadecane) and filtered from any solids present. Subsequently, the solution was adjusted to pH=1-2 using concentrated hydrochloric acid and admixed with 20 ml of dichloromethane. The gelatinous solid that precipitated out was filtered through kieselguhr and rinsed with approximately 25 ml of dichloromethane. The organic phase was separated off. The aqueous phase was extracted again three times, each time with 80 ml of dichloromethane. The combined organic phases are washed with 50 ml of saturated common salt solution before they are then dried over $Na_2SO_4$. After the solvent is removed under reduced pressure, an oily, mostly gold-brown residue remained which was analyzed with respect to its composition by gas chromatography. The gas-chromatographic analysis of the organic crude products gave typical compositions, based on lignin used (% by weight), which are summarized in table 1.

TABLE 1

| | | Yield [% by weight] [1)] | | | |
|---|---|---|---|---|---|
| Example | Electrolyte | Vanillin | Acetovanillin | Guiacol | Vanillic acid |
| 7 | 3M NaOH | 1.61 | 0.36 | 0.09 | 0.27 |
| 8 | 2M NaOH | 1.51 | 0.42 | — | 0.23 |
| 9 | 1M NaOH | 2.84 | 0.04 | — | — |

[1)] Determination using gas chromatography against internal standard, based on kraft lignin used (% by weight).

EXAMPLE 10

The procedure was carried out in a similar manner to example 7 with the following variation: 525-526 mg of kraft lignin were dissolved with stirring in 85 g of 3 M aqueous NaOH in an undivided cell. The cell is equipped with anode and cathode consisting of cupro silver (3.0×4.0 $cm^2$) which were mounted in parallel to one another at a distance of 0.5 cm. The solution was electrolyzed for 17.2 h (Q=1411 C). The maximum cell voltage during the reaction was 2.9 V.

The yields of the organic extracts, based on lignin used (% by weight), were: 1.51% vanillin, 0.15% acetovanillone.

We claim:

1. A method for producing vanillin, which comprises an electrochemical oxidation of an aqueous, lignin-comprising suspension or solution at an anode, wherein the anode used is a silver electrode to produce vanillin, wherein the yield of vanillin obtained with the silver electrode is higher than the yield obtained when the process is conducted with the corresponding nickel electrode.

2. The method according to claim 1, wherein, as silver electrode, an electrode is used in which silver or a silver-comprising alloy is arranged as coating on an electrically conducting support that is different from silver.

3. The method according to claim 2, wherein expanded metals or metal sheets are used as supports of the silver coating.

4. The method according to claim 1, wherein the electrode used as cathode has a surface which is silver, nickel, silver comprising alloys, RuOxTiOx mixed oxides, platinated titanium, platinum, stainless steel, graphite or carbon.

5. The method according to claim 1, wherein the electrolysis is carried out at a current density in a range from 1 to 1000 mA/cm2.

6. The method according to claim 1 wherein the electrochemical oxidation is carried out at temperatures in a range from 0 to 100° C.

7. The method according to claim 1, wherein the electrochemical oxidation is carried out at pressures below 1000 kPa.

8. The method according to claim 1, wherein the aqueous, lignin-comprising suspension or solution used is a lignin-comprising stream from the production of paper pulp, pulp or cellulose.

9. The method according to claim 1, wherein the lignin-comprising suspension or solution is produced by dissolving or suspending at least one lignin-comprising material which is selected from lignin from black liquor, kraft lignin, lignosulfonate, alkali lignin, organosolv lignin and corresponding residues from the paper industry, pulp production or cellulose production.

10. The method according to claim 1, wherein the aqueous lignin-comprising suspension or solution comprises 0.5 to 30% by weight of lignin or a derivative of lignin, based on the total weight of the aqueous, lignin-comprising suspension or solution.

11. The method according to claim 1, wherein the aqueous lignin-comprising suspension or solution is produced by dissolving or suspending oxidized lignin that was obtained from a previous cycle of the electrochemical oxidation.

12. The method according to claim 1, wherein the aqueous lignin-comprising suspension or solution has a pH in a range from 7 to 13.

13. The method according to claim 1, wherein the vanillin formed in the electrochemical oxidation is continuously removed from the aqueous, lignin-comprising solution or suspension.

14. The method according to claim 13, wherein the vanillin formed in the electrochemical oxidation is removed from the aqueous, lignin-comprising solution or suspension by continuous extraction with an organic solvent.

15. The method according to claim 1, wherein the vanillin is removed from the aqueous, lignin-comprising solution or suspension by solid phase extraction.

16. A method of flavoring a food product, comprising:

producing vanillin according to the process according to claim 1; and adding the vanillin to a food product.

17. The method according to claim 1, wherein the electrochemical oxidation is carried out at temperatures in a range from 50 to 95° C.

18. The method according to claim 1, wherein the electrochemical oxidation is carried out at temperatures in a range from 75 to 90° C.

* * * * *